United States Patent [19]

Smith

[11] 4,090,509

[45] May 23, 1978

[54] VITAL EMERGENCY SURVIVAL TIME (VEST)

[76] Inventor: Ronald E. Smith, 1212 Iowa, Ridgecrest, Calif. 93555

[21] Appl. No.: 743,019

[22] Filed: Nov. 18, 1976

[51] Int. Cl.[2] ..... A62B 7/00

[52] U.S. Cl. ..... 128/142.5

[58] Field of Search ..... 128/142.5, 142

[56] References Cited

U.S. PATENT DOCUMENTS

| | | | |
|---|---|---|---|
| 46,477 | 2/1865 | Lane | 128/142.5 X |
| 771,801 | 10/1904 | Andrew | 128/142.5 X |
| 3,208,449 | 9/1965 | Bartlett, Jr. | 128/142 X |

FOREIGN PATENT DOCUMENTS

| | | | |
|---|---|---|---|
| 1,249,696 | 9/1967 | Germany | 128/142.5 |
| 464,980 | 4/1937 | United Kingdom | 128/142.5 |

*Primary Examiner*—John D. Yasko

*Attorney, Agent, or Firm*—R. S. Sciascia; Roy Miller; Thomas W. Hennen

[57] ABSTRACT

A garment providing an emergency source of breathing gas is disclosed which utilizes small diameter tubing to form a reservoir for storage of high-pressure gas. A mask and pressure regulator attached to the reservoir enable a user to tap the stored gas. The tubing reservoir may be incorporated in the fabric of the garment, or retained between layers of the garment. A lightweight shielding layer protects the user against injury caused by accidental rupture of the high-pressure reservoir.

16 Claims, 4 Drawing Figures

VITAL EMERGENCY SURVIVAL TIME (VEST)

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

This invention pertains to emergency survival and rescue breathing equipment, and more particularly to lightweight self-contained breathing apparatus.

2. Description of the Prior Art

Firemen and other rescue workers have long been confronted with the problems of obtaining breathable air while attempting to rescue victims from smoke-filled rooms. Commonly, firemen have used large tanks of breathing gas strapped to their backs and connected through pressure reducing regulators to a breathing mask in order to carry a supply of breathable gas with them into toxic or oxygen deficient environments. These tanks are often bulky and awkward as well as heavy, and although they supply a large quantity of breathable gas, they also present certain hazards to the firefighter. Such tanks usually include a valve at one end which, if damaged or broken by falling debris, for example, could cause the tank to become a rocket strapped to the firefighter's back. Also, the tank being outside the fireman's turnout coat, it could become snagged on surrounding structure and trap the fireman.

Generally, firemen only don the air tank when specifically required to perform a rescue. Since the breathing apparatus commonly worn by firefighters is so bulky and cannot be worn at all times, problems may occur at the fire site. For example, firefighters have on occasion entered burning buildings without breathing apparatus, observed unconscious victims in need of rescue, and returned to their vehicle to don their breathing apparatus before finally rescuing the victim. Such a delay in performing the rescue could, and often does, mean the difference between life and death to the victim. Also, firefighters may lose their own lives if they encounter a smoke-filled environment and do not have breathing apparatus available to them.

Accordingly, one feature of the present invention is that it provides non bulky, light weight breathing apparatus which is part of the fireman's uniform, and is easily carried at all times for use only when needed. Conventional tanks may be used to augment the breathing gas supply when extended breathing time is required.

SUMMARY OF THE INVENTION

The problems associated with conventional breathing apparatus have been overcome by the present invention which includes a high-pressure breathing gas reservoir in the form of small diameter tubing which is incorporated into the structure of the uniform of the fireman or other rescue personnel. The tubing is arranged to be flexible in accordance with natural body movements, and may be interwoven with a portion of the uniform. The tubing reservoir supplies a high pressure gas to a pressure regulator which lowers gas pressure and furnishes low pressure gas to a conventional demand mode regulator and breathing mask which are worn by the firefighter.

In order that the limited storage volume within the tubing be adequate to store a sufficient quantity of breathing gas, the breathing gas stored in the tubing is stored at ultra-high pressure. Pressure in the tubing may well reach 20,000 psi when fully charged. In the event of tubing rupture, the tubing would vigorously release air, but would not explode and throw shrapnel the way a conventional air tank might if damaged. A layer of protective material, such as that utilized in flack jackets or bullet proof vests, is placed between the tubing reservoir and the firefighter. This protective layer is made a portion of the garment and serves to prevent injury which may be caused by accidental rupture of the tubing.

The configuration of the tubing depends upon the breathing gas volume required, as well as the diameter of the tubing. Tubing diameter may be as small as 0.01 inches, and tubing of such dimension may well be interwoven with the fabric of the garment in which it is installed.

While the emergency breathing apparatus of this invention is not in use, the mask is simply stored in one of the pockets of the garment. The reservoir may be charged with any blend of breathing gas from pure oxygen, to air, to any other desired mixture.

BRIEF DESCRIPTION OF THE DRAWING

Further advantages of the present invention will emerge from a description which follows of the preferred embodiment in the form of a fireman's turnout coat incorporating breathing apparatus according to the invention, given with reference to the accompanying drawing figures in which.

DESCRIPTION OF THE PREFERRED EMBODIMENT

Figure 1:
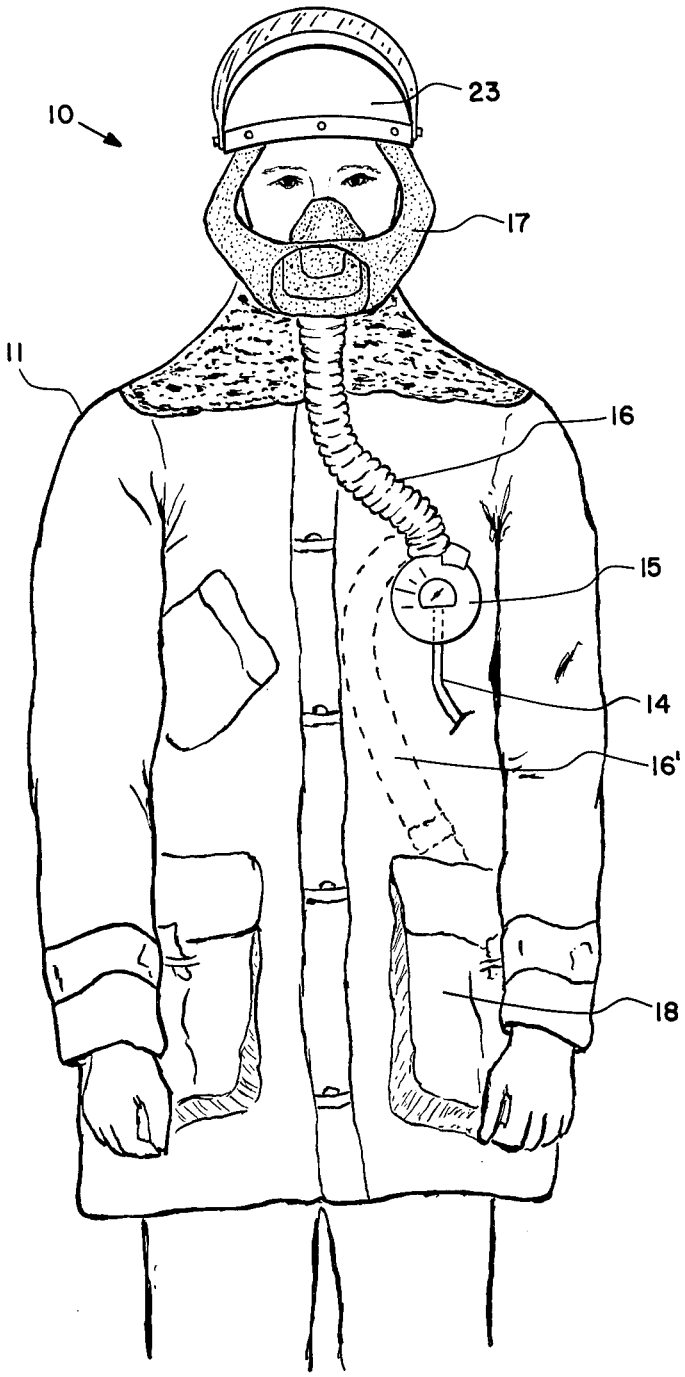
FIG. 1 illustrates a front view of a fireman wearing a turnout coat equipped with breathing apparatus according to the invention.
Figure 2:
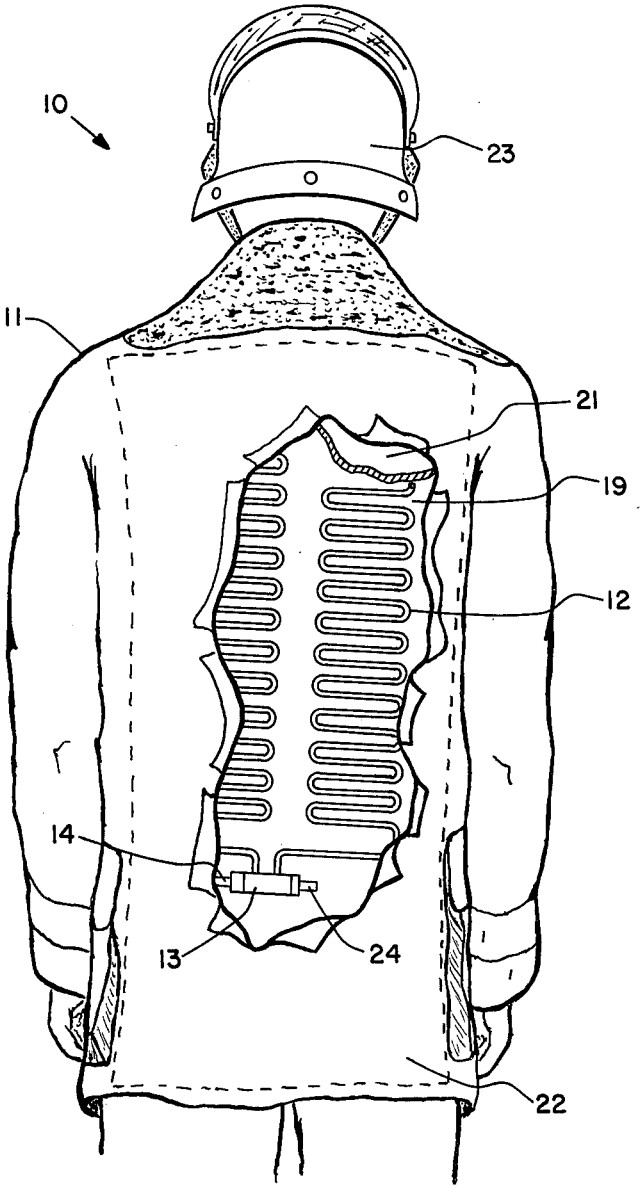
FIG. 2 shows a partially cut away back view of a fireman wearing a turnout coat equipped with breathing apparatus according to the invention.

Referring now to the drawings, wherein like reference numerals refer to like parts and elements throughout the several figures there is shown in FIG. 1 fireman 10 wearing turnout coat 11 and helmet 23. Turnout coat 11 is shown equipped with breathing mask 17 which is supplied by low pressure hose 16 which connects with demand mode regulator 15. Regulator 15 is supplied with low pressure air by conduit 14 which connects with primary regulator 13 which is shown in FIG. 2. Mask 17 and hose 16 when not in use may be stored in pocket 18. When so stored, hose 16 is in the position shown at 16'.

FIG. 2 more clearly shows tubing 12 which forms the reservoir of high pressure breathing gas. Tubing 12 is formed into a series of coils and is positioned to permit maximum body movement and flexibility. Coils 12 empty into primary regulator 13. Protective layer 19 provides protection between the firefighter and coils 12 to insure against injury if coils 12 should accidentally rupture while pressurized. Protective layer 19 substantially covers the back of turnout coat 11 and extends from high on the firefighter's back to the lower limits of the turnout coat 11. If coils 12 are designed to wrap around the garment to provide a larger gas storage capacity, protective layer 19 also will extend around the front of garment 11 to provide full protection. Protective layer 19 and coils 12 are sandwiched between outer shell 22 and lining 21. Primary regulator 13 includes charging fitting 24 which enables rapid recharging of depleted coils 12 with compressed gas. Fitting 24 could be located as shown on primary regulator 13 or could be extended or relocated to the front of turnout coat 11 to make the recharging operation easy for the firefighter to perform without having to remove the coat.

Figure 3:
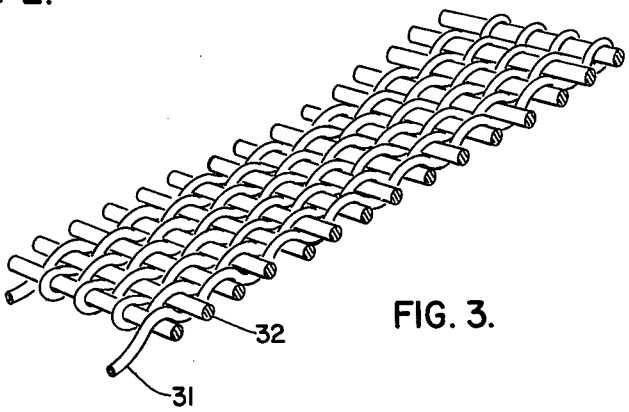
FIG. 3 shows a portion of fine diameter tubing interwoven with other fibers to form a fabric which may be incorporated into a garment.

FIG. 3 illustrates how a length of small diameter tubing 31 may be interwoven among other coarse fibers 32 to incorporate tubing 31 as a part of the fabric of the garment in which breathing apparatus is to be installed. Such construction would enable the installation of emergency breathing apparatus in a wide variety of garments other than a fireman's turnout coat. For example, the apparatus of this invention could be included in an upper body garment such as a vest which could be worn by any rescue worker under other parts of his uniform, or it could be included in cover-all type garments, or even trousers.

The material for use in tubes 12 should be lightweight, strong material which has low work hardening characteristics. One such material is maraging stainless steel. Assuming it is desired to provide a 15 minute supply of breathing gas, the weight of tubing manufactured from maraging stainless steel if charged to 20,000 psi, and allowing a factor of safety of two, would be approximately 3.4 pounds. Such a construction would require approximately 4,200 feet of 0.03125 inch outside diameter tubing. Similarly, if 0.250 inch outside diameter tubing is used, approximately 70 feet is required.

Of course, any compatible regulator and mask could be used in this invention, and different types of masks may be desirable in different applications and toxic environments. Also, any length and diameter of tubing configured to any form could be used in the invention and need only be positioned in the garment so as not to interfere with normal body movements. The high pressures attainable in the tubing, however, dictate that protective layer 19 be positioned for safety between tubing 12 and the body of the wearer. Protective layer 19 may advantageously be constructed from a lightweight fabric having superior resistance to penetration, such as ballistic nylon.

Figure 4:
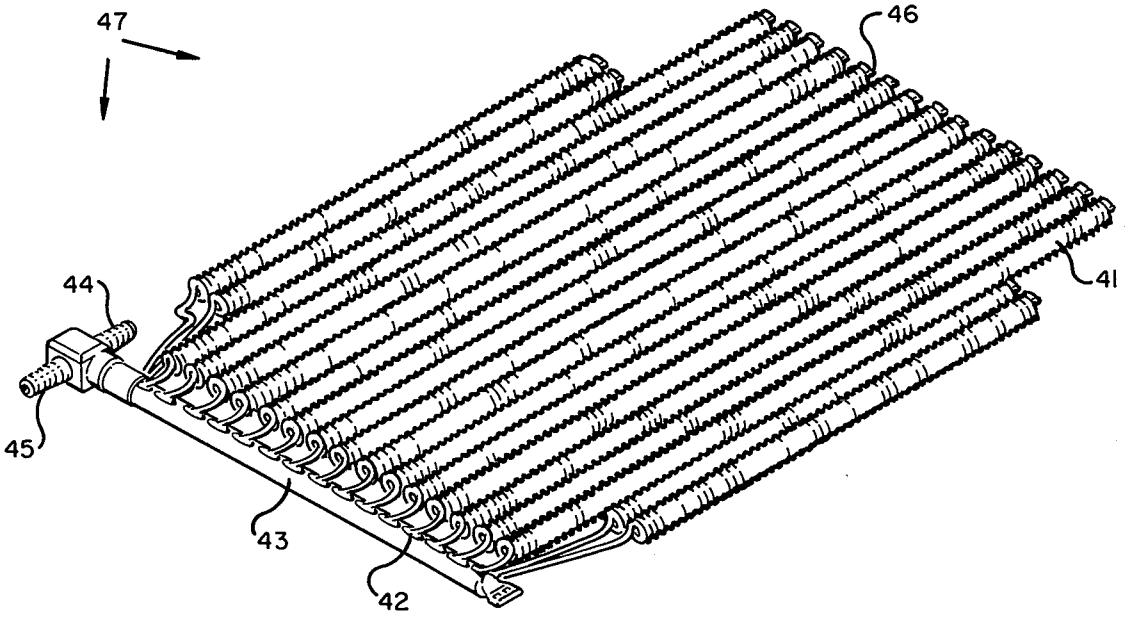
FIG. 4 shows an alternative reservoir configuration.

FIG. 4 illustrates one possible configuration of coils 41 for reservoir assembly 47. Coils 41 are constructed to have one end closed at 46, and are joined on the other end to manifold 43 at attachment point 42 by oven brazing or other attachment means. Manifold 43 empties through outlet 44 which supplies high pressure gas to a regulator. Reservoir assembly 47 is recharged from a source of compressed gas (not shown) through appropriate valving means (not shown in FIG. 4) and through inlet 45. Coils 41 may be stacked as shown, or may be angled or skewed to reduce coil layer thickness. Angled coils would permit additional coil layers to be installed.

Actual construction of a reservoir assembly may include lacing individual coils together with a flexible material such as nylon cord, thread or the like, and providing a lubricated surface between individual coils to prevent chafing or abrasion. A teflon coating or the like may be applied to the surface of the coils for this purpose.

The invention has been described in an illustrative manner and it is to be understood that the terminology which has been used is intended to be in the nature of words of description rather than of limitation. Obviously many modifications and variations of the present invention are possible in the light of the above teachings. It is therefore to be understood that within the scope of the appended claims the invention may be practiced otherwise than as specifically described.

What is claimed is:

1. Apparatus for providing an emergency source of breathing gas to a user, said apparatus comprising:

a garment;

at least one gas storage vessel formed from tubing and attached to said garment;

gas pressure reduction means operably connected to said gas storage vessel;

at least one breathing mask operably connected to said gas pressure reduction means; and a penetration resistant protective layer attached to said garment and positioned adjacent said gas storage vessel for protecting said user against injury in case of gas storage vessel failure.

2. Apparatus as set forth in claim 1 wherein said gas pressure reduction means comprises a primary regulator and a demand mode regulator.

3. Apparatus as set forth in claim 1 wherein said gas storage vessel contains oxygen gas.

4. Apparatus as set forth in claim 1 further comprising means for filling said gas storage vessel from a separate source of compressed breathing gas.

5. Apparatus as set forth in claim 1 wherein said garment has a front, a back, an inner lining and an outer shell.

6. Apparatus as set forth in claim 1 wherein said garment comprises a fabric made from said gas storage vessel tubing.

7. Apparatus as set forth in claim 1 wherein said garment is an upper body garment.

8. Apparatus as set forth in claim 1 wherein said gas storage vessel is made from maraging stainless steel.

9. Apparatus as set forth in claim 5 wherein said gas storage vessel is retained between said inner lining and said outer shell, and said protective layer is positioned between said gas storage vessel and said inner lining.

10. Apparatus as set forth in claim 5 wherein said gas storage vessel is positioned in the back of said garment.

11. Apparatus for providing an emergency source of breathing gas to a user, said apparatus comprising:

a garment;

a gas storage reservoir having a manifold and a plurality of separate tubing branches each having one closed end and one open end, each of said tubing open ends sealingly communicating with said manifold;

gas pressure reduction means operably connected to said manifold for selectively reducing the pressure of gas flowing from said gas storage reservoir;

at least one breathing mask operably connected to said gas pressure reduction means; and a penetration resistant protective layer attached to said garment and positioned adjacent said gas storage reservoir for protecting said user against injury in case of gas storage reservoir failure.

12. Apparatus as set forth in claim 11 wherein said separate tubing branches are configured as coils.

13. Apparatus as set forth in claim 11 wherein said penetration resistant protective layer comprises ballistic nylon.

14. Apparatus as set forth in claim 11 wherein said tubing branches comprise stainless steel.

15. Apparatus as set forth in claim 11 wherein said gas pressure reduction means comprises a primary regulator and a demand mode regulator.

16. Apparatus as set forth in claim 11 wherein said garment comprises a fireman's turnout coat.

* * * * *